US008215506B2

(12) United States Patent
Soehnlen et al.

(10) Patent No.: US 8,215,506 B2
(45) Date of Patent: Jul. 10, 2012

(54) FLIP TOP CLOSURE ASSEMBLY FOR A BOTTLE

(75) Inventors: Daniel P. Soehnlen, Canton, OH (US); Gregory M. Soehnlen, North Canton, OH (US)

(73) Assignee: Creative Edge Design Group, Ltd., Canton, OH (US)

( * ) Notice: Subject to any disclaimer, the term of this patent is extended or adjusted under 35 U.S.C. 154(b) by 288 days.

(21) Appl. No.: 12/524,272

(22) PCT Filed: Jan. 23, 2008

(86) PCT No.: PCT/US2008/051781

§ 371 (c)(1), (2), (4) Date: Aug. 5, 2009

(87) PCT Pub. No.: WO2008/091936

PCT Pub. Date: Jul. 31, 2008

(65) Prior Publication Data

US 2010/0051574 A1 Mar. 4, 2010

(51) Int. Cl.
*B67D 3/00* (2006.01)

(52) U.S. Cl. ..... 215/235; 222/556

(58) Field of Classification Search ..... 215/235, 215/316; 222/556

See application file for complete search history.

(56) References Cited

U.S. PATENT DOCUMENTS

| | | | | | |
|---|---|---|---|---|---|
| 2,102,349 | A | * | 12/1937 | Baron | 222/469 |
| 2,790,475 | A | * | 4/1957 | Close | 220/254.3 |
| 3,739,957 | A | * | 6/1973 | Alpern | 222/556 |
| D249,925 | S | * | 10/1978 | Rice | D7/379 |
| 4,541,529 | A | | 9/1985 | Hestehave et al. | |
| D288,667 | S | * | 3/1987 | Miner | D9/443 |
| 4,881,647 | A | | 11/1989 | Schiemann | |
| 5,579,961 | A | * | 12/1996 | Zimmerman | 222/545 |
| 5,823,345 | A | * | 10/1998 | Nask et al. | 206/509 |
| 6,164,503 | A | * | 12/2000 | Forsyth et al. | 222/556 |
| 6,591,986 | B2 | * | 7/2003 | Soehnlen et al. | 206/434 |
| 6,817,473 | B2 | * | 11/2004 | Schwaikert | 206/508 |
| D583,234 | S | | 12/2008 | Lohrman et al. | |
| 7,717,281 | B2 | * | 5/2010 | Baudin | 215/235 |
| 2002/0175206 | A1 | | 11/2002 | Nance | |
| 2006/0186077 | A1 | | 8/2006 | Robinson | |

FOREIGN PATENT DOCUMENTS

| | | | |
|---|---|---|---|
| WO | WO 01/38190 | A1 | 5/2001 |
| WO | 2007/006957 | A1 | 1/2007 |

OTHER PUBLICATIONS

International Search Report and Written Opinion for PCT/US2008/051781.

* cited by examiner

*Primary Examiner* — Tri Mai
(74) *Attorney, Agent, or Firm* — Fay Sharpe LLP

(57) ABSTRACT

A flip top closure assembly for a bottle Includes a base portion affixed onto a neck of the bottle and a cap portion connected to the base portion The base portion Includes a peripheral skirt for engagement with the bottle and a wall extending inwardly from atop the skirt The wall has a generally diamond-shaped opening therein that defines a pour opening A pouring lip extends upwardly from the skirt The pouring lip and a portion of the wall define a pouring spout adjacent a first apex of the pour opening At least a portion of the pouring spout extends outwardly past an outermost periphery of a side wall of the bottle The cap portion includes a substantially planar flip top hingedly connected to the base portion adjacent to a second apex of the pour opening.

6 Claims, 5 Drawing Sheets

FLIP TOP CLOSURE ASSEMBLY FOR A BOTTLE

BACKGROUND

The present invention relates to bottles, receptacles, and container structures. Specifically, the present invention relates to a flip top closure assembly for a liquid container for a comestible product such as milk, juice, flavored water, etc. However, it is to be appreciated that the present invention is also amenable to other like applications.

Many consumer products are packaged in containers with flip-top dispensing closures. Typically, flip top closures have round orifices with round plugs that seal the orifice when the top is closed and may have pour spouts that are also round and encircle the round orifice. The sale of such products in containers having flip top closures has enhanced the consumers experience in the use of many consumer products, thus helping to increase their popularity. However, such conventional flip top closures can be messy to use and do not pour well.

A precise cutoff during the pour is desired so that there is no leakage or dripping. In conventional bottles, the edge of the pour spout is not well defined, e.g., a rounded opening that relies on the direction of pouring to determine what portion of the rounded opening receives the fluid. Although this may provide some flexibility for the user, it does not provide an effective pour lip.

Moreover, known caps position or locate the edge of the pour lip within the confines of the side wall of the bottle. Thus, if the fluid is not abruptly cut off when the pour is terminated, the shape of the bottle promotes the dripping of the fluid down the side wall of the bottle. This, of course, is not desirable.

In addition to the convenience of the flip top arrangement, the bottle manufacturer desires the convenience of a threaded cap, as well as a foil seal for purposes of contamination protection. These three competing concerns lead to different, divergent design traits that are difficult to incorporate into an integrated design.

As part of a caseless shipping system, the cap preferably provides a large planar area or upper surface in order to facilitate the transfer of vertical loads or forces through a stacked array. Particularly, it is important to transfer forces from an adjacent upper layer or row of bottles to an upper surface of a bottle, vertically through the sidewall of the bottle, to the lower surface of the bottle where the forces are then transferred in the same manner to the next adjacent lower layer or row of bottles. A commercially successful version of the caseless shipping arrangement as used in the dairy industry is shown and described in commonly owned U.S. Pat. Nos. 6,247,507 and 6,068,161 the disclosures of which are incorporated herein by reference.

It is desired to improve the pouring capabilities of the cap. Adequate air flow is desired to prevent "glugging" of the fluid as the fluid is poured from the bottle. This promotes laminar flow as the fluid is poured from the bottle.

Accordingly, the present invention provides an improved flip top closure assembly which overcomes certain difficulties with the conventional designs while providing better and more advantageous overall results.

BRIEF DESCRIPTION

In accordance with the present invention, a flip top closure assembly for a bottle or container comprises a base portion affixed onto a neck of the bottle and a cap portion connected to the base portion. The base portion includes a peripheral skirt for engagement with the container and a wall extending inwardly from atop the skirt. The wall has a pour opening. A pouring lip extends upwardly from the skirt. The pouring lip and a portion of the wall define a pouring spout. At least a portion of the pouring spout extends outwardly past a side wall of the bottle. The cap portion includes a substantially planar flip top hingedly connected to the base portion adjacent to a second apex of the pour opening. The flip top has an open and close position. In the close position, a top surface of the flip top lies substantially in a plane defined by a top wall of the bottle.

A foil seal may be incorporated into the assembly to seal the neck of the bottle. The seal is preferably heat sealed or fusion bonded to the bottle at the opening in the neck, i.e., beneath the base portion of the closure assembly.

Preferably the neck of the bottle is externally threaded in order to threadably receive the closure assembly. Particularly, the base portion is internally threaded for mating engagement with the neck threads to facilitate mounting the closure assembly on the bottle.

Still other aspects of the invention will become apparent from a reading and understanding of the detailed description of the embodiment described hereinbelow.

DETAILED DESCRIPTION

It should, of course, be understood that the description and drawings herein are merely illustrative and that various modifications and changes can be made in the structures disclosed without departing from the scope and spirit of the present invention. It will be appreciated that the various identified components of the closure assembly and bottle or container disclosed herein are merely terms of art that may vary from one manufacturer to another and should not be deemed to limit the present invention. Those of ordinary skill will also recognize that the bottle described herein is scalable to achieve virtually any size comprising a blow-molded plastic, although different manufacturing techniques may be used.

Figure 1:
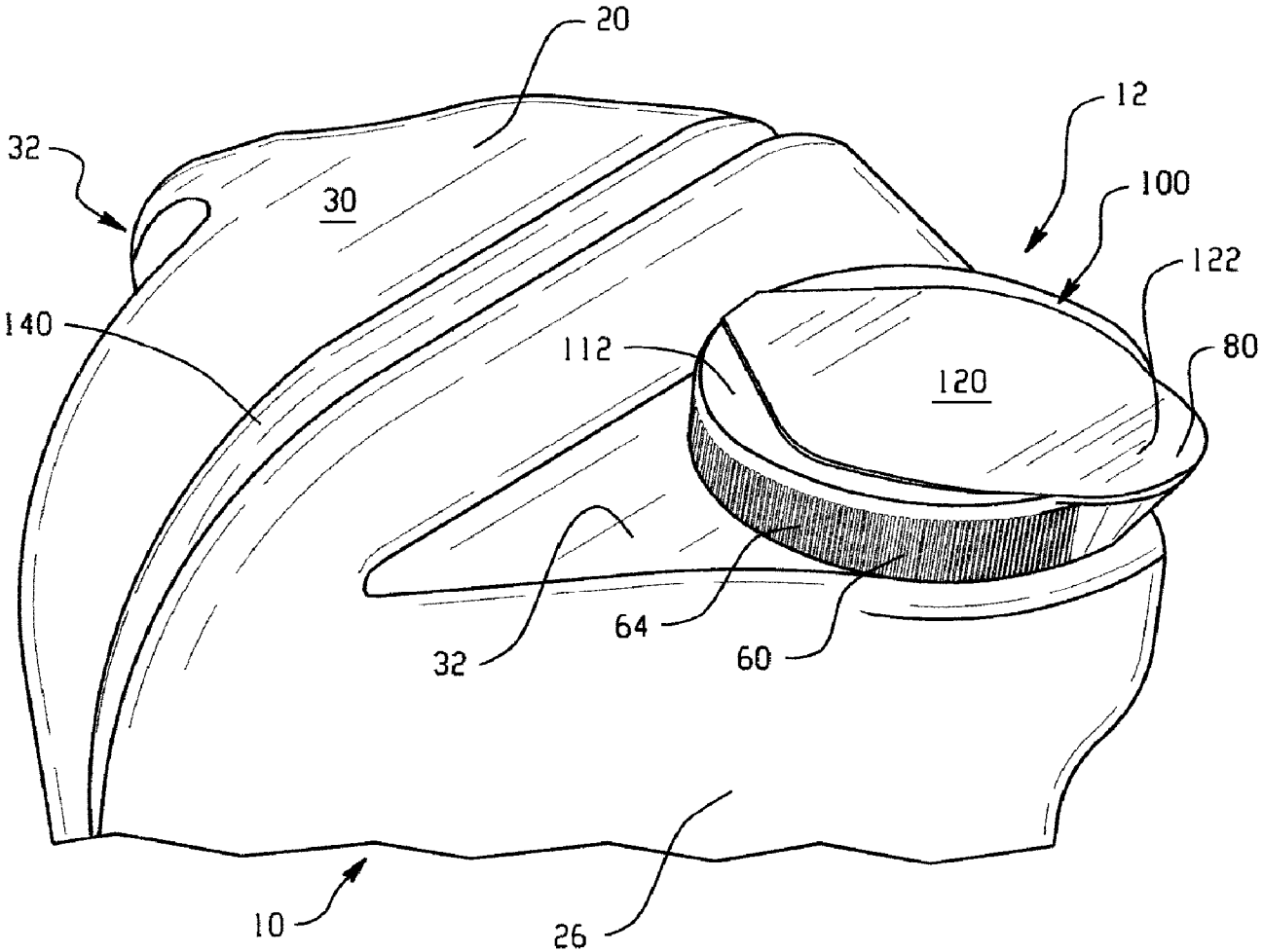
FIG. 1 is a partial top perspective view of a bottle including a closure assembly according to the present invention, the closure assembly being illustrated in a closed position.
Figure 2:
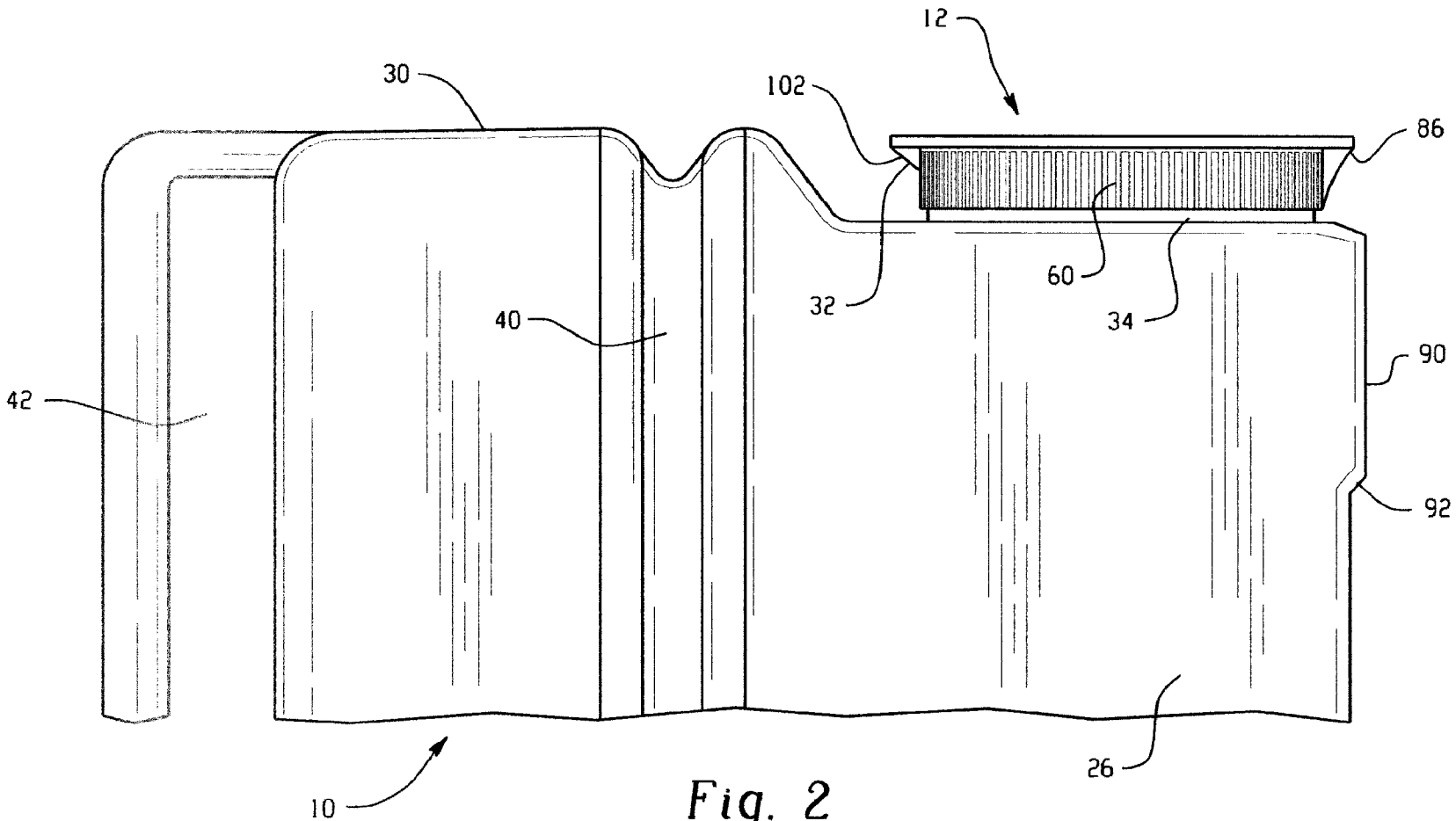
FIG. 2 is partial side elevational view of the bottle of FIG. 1.
Figure 3:
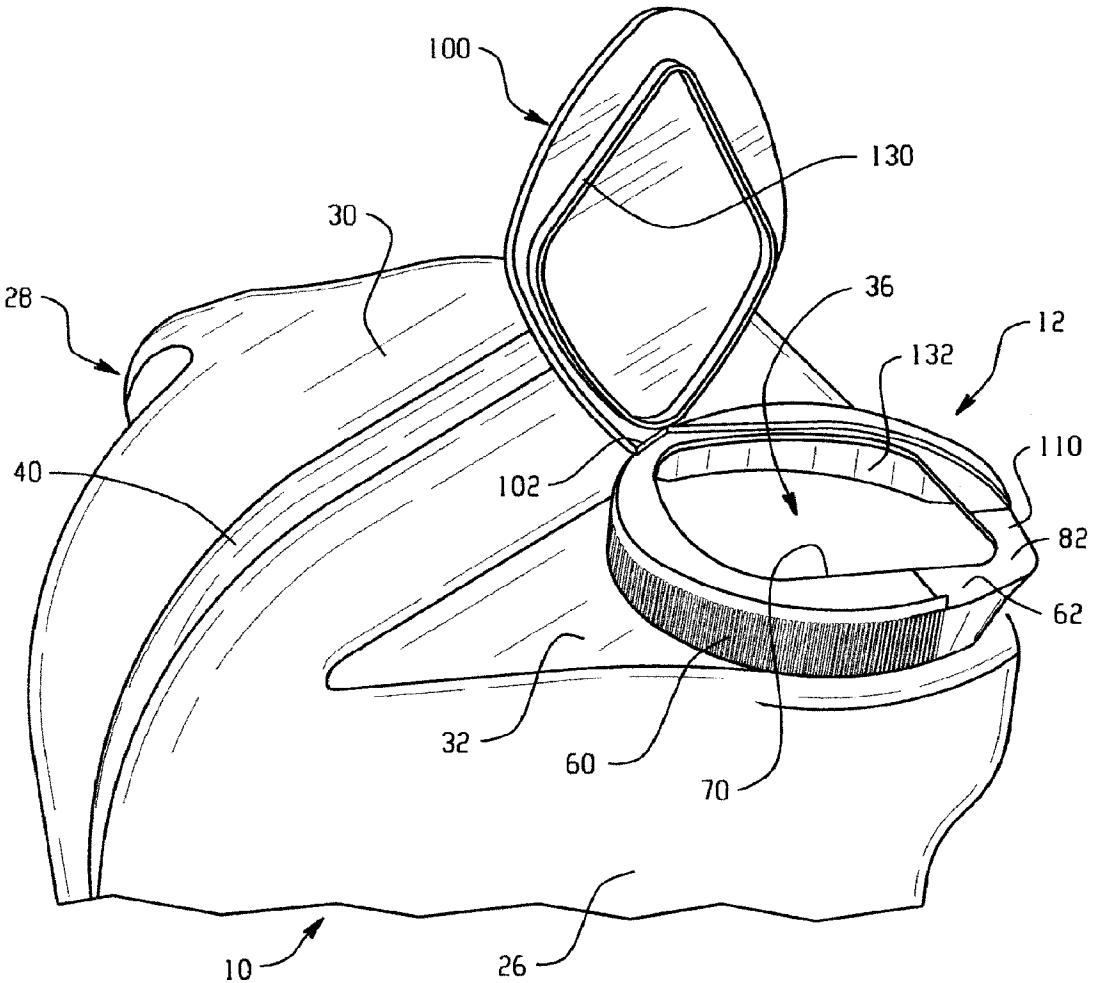
FIG. 3 is a partial top perspective view of the bottle of FIG. 1 illustrating the closure assembly in an open position.

Referring now to the drawings, wherein like numerals refer to like parts throughout the several views, FIGS. 1-3 illustrate a bottle designated generally by the number 10, and a closure assembly, designated generally by the number 12, according to the present invention for holding and selectively dispensing or pouring a fluid such as a liquid therefrom. In particular, the bottle finds particular application in the dairy industry for milk, juice, flavored waters, etc.

The bottle may be a standard (3-liter or 1 gallon) size container or any other size. The bottle 10 includes a planar upper or top surface 20, a bottom surface (not shown) and a side wall 26 molded integrally therewith. The top surface and bottom surface are of a generally diamond shape with one apex thereof coinciding with an integrally molded handle 28. The handle proceeds from the top surface along the apex and terminates adjacent the bottom surface.

The top surface 20 in conjunction with the cap defines an enlarged planar upper surface that has a large footprint for supporting a next adjacent bottle(s) when postioned in stacked array for shipment without the use of cases, i.e., caseless shipping. The top surface includes a recessed or stepped conformation having an upper surface 30 and lower level portion 32 which is slightly vertically recessed from the upper surface. A neck 34 extends upwardly from the lower portion adjacent an opposite apex of the diamond-shape from the handle. The neck has a generally cylindrical configuration and preferably includes external threads (FIG. 7) for threadably receiving the closure assembly 12 as will be described in greater detail below. An orifice or opening 36 is formed in an upper portion of the neck for ingress and egress of the liquid or other material contained in container 10. The upper portion of the neck defines a plane which is generally transverse to the axis of the neck 34. The upper terminal end of the neck is slightly below the upper surface 30 so that once the closure assembly is positioned on the neck, the top of the closure assembly is substantially co-planar with the upper surface and provides a planar upper surface that extends over greater than fifty percent of the total upper footprint of the bottle.

The wall 26 is preferably formed with a number of structural load distributing or load transferring features 40 which increase the sectional modulus of wall 26 and prevent bending and/or buckling when the wall thickness is minimized to limit the amount of plastic required to form the bottle. The ribs are generally of a "V" shape in cross-section, with the apex of the "V" extending inward of the container and are substantially continuous along the longitudinal height of the bottle. This structure permits the construction of molds without the presence of undercuts, which are inefficient from a manufacturing standpoint. The vertical ribs or flutes 40 can be incorporated into vertical surfaces of the wall 26 in an effort to reduce the unbraced length of the wall and limit deflections. For example, at least one of the structural load distributing ribs or flutes is a continuous flute that proceeds through the substantially planar surface of the top surface 30 and down opposite sides of the bottle toward the bottom surface. This flute is preferably situated between the closure assembly 12 and the handle 28, again to minimize the unbraced dimensions of the bottle since the handle also functions as a load distributing feature disposed at the apex of the horizontal cross-section of the bottle.

With continued reference to FIGS. 1-3, the handle 28 is formed integrally with the bottle 10, e.g., the bottle is blow molded. One end of the handle extends from the upper surface 30 of the container to provide additional support thereto. An opposite or lower end (not shown) of the handle extends or merges into the wall 26. A finger clearance opening 42 is dimensioned to provide comfort for a large range of consumer hand sizes. The finger receiving region is thus disposed adjacent the handle and preferably terminates before reaching the bottom surface of the container. Further details of the above bottle 10 are shown and described in the commonly owned patent noted above and are understood by one skilled in the art so that further discussion herein is deemed unnecessary.

Figure 5:
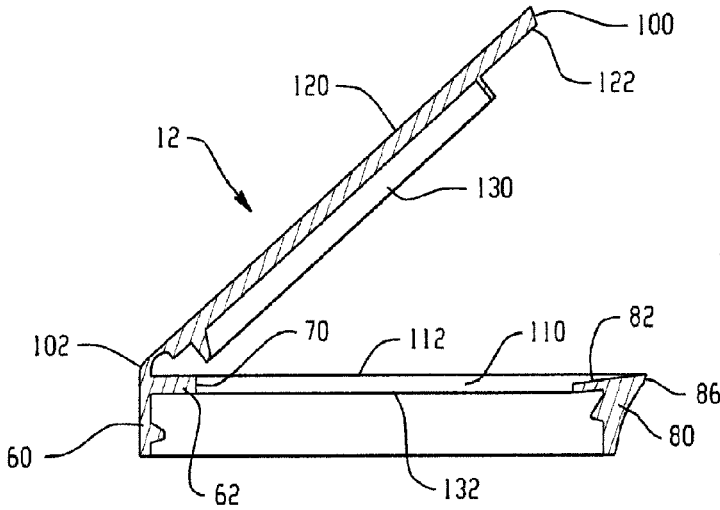
FIG. 5 is a longitudinal cross-sectional view of the closure assembly in an open position.
Figure 6:
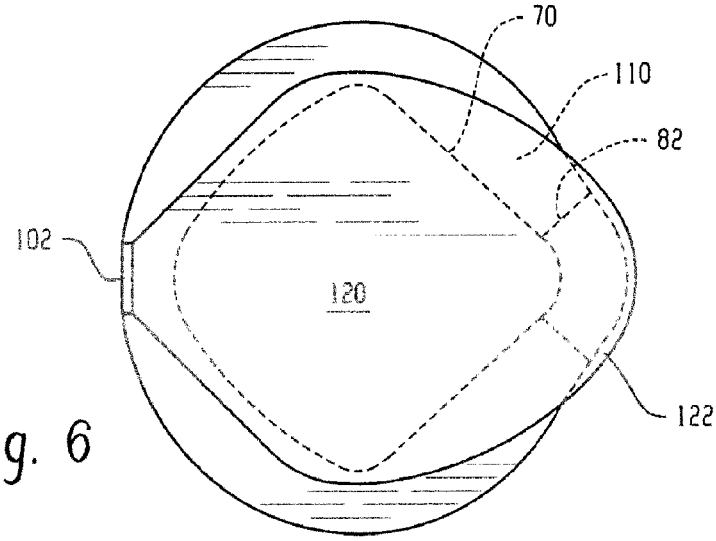
FIG. 6 is a top plan view of the closure assembly shown in a closed position.

The closure assembly 12 preferably comprises a base portion including a generally cylindrical skirt 60 and an end wall 62 extending inwardly from atop the skirt, generally in a plane transverse to the axis of the skirt. The skirt includes internal threads (FIGS. 5 and 7) which are complementary to the external threads on the bottle neck 34 thereby allowing the closure assembly 12 to be threaded completely onto the externally threaded neck of the container 10. The threads are formed so that the closure assembly has a predetermined orientation on the bottle. The external surface of the sleeve portion skirt 60 is knurled or ribbed with longitudinal ribs 64 (FIGS. 1-3). These ribs provide a better surface for gripping when tightening or loosening the closure assembly from the bottle.

The base portion of the closure assembly further includes a pour opening or dispensing aperture 70 (FIGS. 3 and 5) disposed in the end wall 62, which is in fluid communication with the orifice 36 of the bottle. The aperture 70 is generally diamond-shaped and sized to permit simultaneous egress of fluid through a first or outer apex portion adjacent the outer periphery of the bottle and ingress of air through a second apex portion disposed inwardly of the periphery of the bottle to prevent "glugging." A secondary function of the large aperture is that it provides for easy ingress of fluid and/or powder mixture to the container during filling of the bottle. The aperture also permits the easy deployment of stirring utensils within the bottle.

Figure 7:
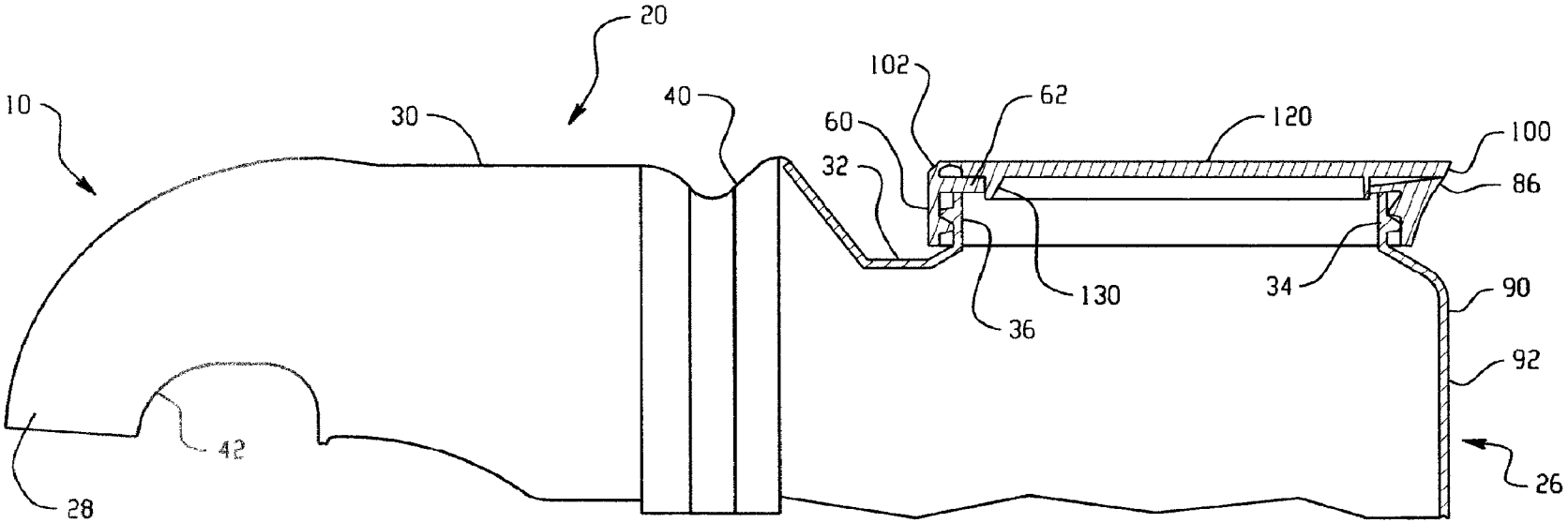
FIG. 7 is an elevational view of an upper end of a bottle with the neck region and closure assembly shown in cross-section.

With particular reference to FIGS. 2 and 3, a pouring lip 80 extends upwardly and outwardly from the skirt 60. The pouring lip and a portion of the end wall 62 define a pouring spout 82. The pouring spout extends outwardly in a direction opposite the handle 28 and terminates outwardly beyond an outer periphery of the container wall 26 (FIGS. 2 and 7). Particularly, the pouring lip 80 includes a pouring edge 86 that curves sharply downward and inward at its extremity to create an anti-drip spout, i.e., the pouring edge provides a sharp cutoff edge. The outer, terminal edge 86 of the pour lip 80 is displaced outward slightly from the outermost surface 90 of the wall 26, and is advantageously outside the inner opening or diameter 70 of the cap. This configuration prevents liquid from running down the front of the bottle 10. The bottle can also include a cup guide 92 which extends downwardly and inwardly and merges with the rest of the wall of the bottle to facilitate proper orientation of the pour spout relative to a cup. It will be appreciated that when fluid is poured from the bottle 10, fluid flows over an apex of the spout 82 which has a taper that proceeds downwardly as it extends radially inward from the periphery defined by the pouring edge 86 and as particularly illustrated in FIGS. 3, 5 and 7. Thus, when the bottle is situated on a horizontal surface, the liquid will flow back in toward the aperture along the pour spout 82. Further, the handle 28 is provided directly opposite the pouring spout to provide self-centering of the spout and facilitate pouring.

As shown in FIGS. 1 and 3, the closure assembly further includes a cap portion that is preferably hingedly connected to the base portion for selectively closing or opening the aperture 70. The cap portion includes a substantially planar flip top 100 connected to the end wall 62 by using suitable means. In the depicted embodiment, the flip top is hinged to the end wall by a living hinge 102. Other hinge structures may be employed, including a snap-action hinge. The hinge extends across a portion of an outer edge of the end wall. The flip top 100 provides a desired extension of the container top surface 30 such that a load imposed on the top surface of the container is more evenly distributed and supported. Accordingly, the end wall 62 is configured with a step down section 110 (FIG. 3) surrounding the aperture 70 so that when the flip top 100 is closed, the flip top lies generally flush with an upper or outside surface 112 of the end wall. An upper surface 120 of the flip top lies substantially in a plane defined by the container upper surface 30 when the base portion 72 is mounted onto the neck 34 of the bottle. This provides a large upper stacking surface that is substantially planar for increased stability. A finger grip ledge 122 (FIG. 1) is also provided on the flip top. The finger grip ledge extends partially outwardly from the pouring edge 86 of the pouring lip 80 to facilitate pivotal movement of the flip top 100.

A downwardly extending rim 130 is formed on the underside of the flip top 100. The rim is shaped and sized accordingly so that it fits securely within the aperture 70 in the end wall 62, such that the rim 66 acts as a plug and forms a releasable seal with the end wall, inward of the pour spout 82. The rim 130 is also sized such that it touches a downwardly extending inner flange 132 of the end wall, the flange at least partially directing fluid to and from the pour spout. Thus, as the flip top 100 is moved from the open position to the closed position, the rim 130 at least partially sweeps adjacent the flange, thereby providing a sealed interface around the periphery of the aperture when the flip top is moved into the closed position.

Figure 4:
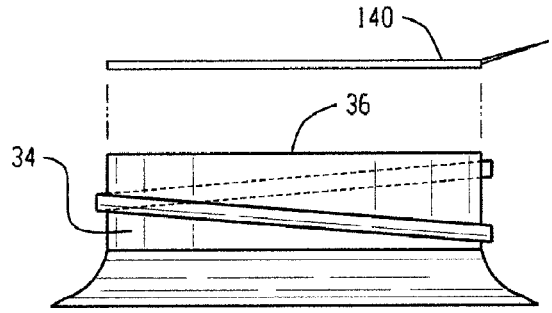
FIG. 4 is an elevational view of the neck region of the bottle.

Although not illustrated, depending on the intended use, a foil seal 140 (FIG. 4) may be provided between the closure assembly 12 and the container 10. The foil seal extends across the orifice 36 of the bottle and is typically provided for tamper resistance and detection as well as enhanced sealing capabilities. When a consumer wishes to dispense the contents of the container, the closure assembly 12 is first unscrewed to provide access to the foil seal. The foil seal is peeled off the orifice and the closure assembly is screwed back onto the container. Preferably the foil seal is fusion bonded or heat sealed to the upper perimeter of the neck orifice and then the closure assembly is threadably received on to the neck.

The subject closure assembly provides a number of desired benefits without requiring additional plastic. For example, this flip-top closure assembly as shown and described uses the same amount of plastic (about 5.7 grams) as a conventional threaded cap. However, it adds the benefits of a profiled pour spout, one-piece flip-cap, pour lip outside the diameter of the neck/cap opening and advantageously beyond the outer periphery of the bottle wall, accommodates a foil seal, is conducive to manufacture with mating threads, and adds substantial planar surface area at the same height as the upper surface of the bottle for use in a caseless shipping system.

The present invention has been described with reference to the above embodiment. Obviously, modifications and alterations will occur to others upon reading and understanding the preceding detailed description. For example, although the above closure assembly has been described as having a screw-on configuration, it will also be appreciated that the closure assembly can be a configured as a snap cap which can be snapped into place over the container neck. It is intended that the present invention be construed as including all such modifications and alterations.

What is claimed is:

1. A flip top closure assembly for an associated bottle comprising:

a base portion affixed onto a neck of the associated bottle, the base portion including:

a peripheral skirt for engagement with the associated bottle, a wall extending inwardly from atop the skirt and having a pour opening therein, a pouring lip extending upwardly and outwardly from the skirt past a sidewall of the associated bottle and terminating in a pouring edge, the pouring lip and a portion of the wall defining a pouring spout adjacent a first apex of the pour opening, wherein at least a portion of the pouring spout extends outwardly past a side wall of the associated bottle, and further extends downwardly and inwardly in tapering fashion from the pouring edge to the pour opening; and a cap portion including a substantially planar flip top hingedly connected to the base portion adjacent to an interior edge of the pour opening, the flip top having open and closed positions, wherein in the closed position, a top surface of the flip top lies substantially in a plane defined by a top wall of the associated bottle.

2. The closure assembly of claim 1, wherein the cap portion includes a diamond-shaped rim extending downwardly from the flip top for forming a seal with the opening and a releasable seal with the end wall.

3. The closure assembly of claim 2, the base portion includes a flange extending downwardly from the base portion wall, wherein the rim of the cap portion sealingly engages the flange as the flip top is moved from the open position to the closed position.

4. The closure assembly of claim 3, wherein the rim is configured to at least partially sweep the flange.

5. The closure assembly of claim 1, wherein the wall of the base portion includes a step down section at least partially surrounding the pour opening for receiving the flip top, the wherein in the closed position the flip top lies generally flush with an upper surface base portion wall.

6. The closure assembly of claim 1 wherein the pour opening has a substantially diamond-shape having a first, radially outer apex portion adjacent an outer periphery of the bottle and a second apex portion disposed inwardly thereof to prevent glugging.

* * * * *